US011256185B2

(12) United States Patent
Heid et al.

(10) Patent No.: US 11,256,185 B2
(45) Date of Patent: Feb. 22, 2022

(54) SHAPED CHARGE GENERATION LAYER FOR A PHOTOCONDUCTIVE DRUM

(71) Applicant: LEXMARK INTERNATIONAL, INC., Lexington, KY (US)

(72) Inventors: Matthew David Heid, Louisville, KY (US); Laura Lee Kierstein, Erie, CO (US); Weimei Luo, Louisville, CO (US); Prasanna Shrestha, Golden, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/877,783

(22) Filed: May 19, 2020

(65) Prior Publication Data

US 2021/0124278 A1 Apr. 29, 2021

Related U.S. Application Data

(63) Continuation of application No. 62/927,203, filed on Oct. 29, 2019.

(51) Int. Cl.

| | |
|---|---|
| ***G03G 5/00*** | (2006.01) |
| ***G03G 5/05*** | (2006.01) |
| ***G03G 5/047*** | (2006.01) |
| ***G03G 5/06*** | (2006.01) |
| ***G03G 5/10*** | (2006.01) |
| ***G03G 5/147*** | (2006.01) |

(52) U.S. Cl.

CPC ..... *G03G 5/0525* (2013.01); *G03G 5/047* (2013.01); *G03G 5/0542* (2013.01); *G03G 5/0696* (2013.01); *G03G 5/102* (2013.01); *G03G 5/147* (2013.01)

(58) Field of Classification Search

CPC .... G03G 5/047; G03G 5/0696; G03G 5/0542; G03G 5/0525

See application file for complete search history.

(56) References Cited

U.S. PATENT DOCUMENTS 4,443,764 A 4/1984 Suh et al.
5,578,410 A * 11/1996 Petropoulos ..... G03G 5/0525 427/430.1
5,929,640 A 7/1999 Tse et al.

(Continued)

OTHER PUBLICATIONS

Diamond, A.S; Weiss, D.S. Handbook of Imaging Materials. New York: Marcel-Dekker, Inc. pp. 145-164. (Year: 2001).*

(Continued)

*Primary Examiner* — Mark A Chapman

(57) ABSTRACT

A photoconductive drum includes an elongated support element with a shaped charge generation layer. The layer extends from the support element at various thicknesses along a length thereof. Thicker charge generation portions provides denser optical densities compared to thinner portions allowing tailoring the photoconductive drum to compensate for imperfect optical scanning systems. A charge transport layer overcoats the charge generation layer. Optionally, an oxidation layer underlies the charge generation layer as does a protective overcoat overlying the charge transport layer. Various thicknesses and shapes of the charge generation layer are also disclosed.

16 Claims, 15 Drawing Sheets

(56) References Cited

U.S. PATENT DOCUMENTS

| | | | | |
|---|---|---|---|---|
| 6,132,923 | A * | 10/2000 | Maty | G03G 5/00 430/129 |
| 7,316,876 | B2 * | 1/2008 | Kobayashi | G03G 5/0564 430/123.4 |
| 7,642,025 | B2 * | 1/2010 | Tada | G03G 17/06 430/56 |
| 2020/0409278 | A1 * | 12/2020 | Makisumi | G03G 5/047 |

OTHER PUBLICATIONS

Duke, C.B.; Noolandi, J.; Thieret, T.; "The surface science of xerography" Surface Science 500, pp. 1005-1023. (Year: 2002).*

English language machine translation of JP 2021-004947. (Year: 2021).*

Dip Coating Theory: Film Thickness; https://www.ossila.com/pages/dip-coating-theory-film-thickness#Thickness-Vs-Speed; at least as of May 18, 2020; pp. 16.

David Quéré; Fluid Coating on a Fiber; Annual Review of Fluid Mechanics; Jan. 1999; vol. 31:347-384; https://www.annualreviews.org/doi/10.1146/annurev.fluid.31.1.347; at least as of May 18, 2020; pp. 39.

* cited by examiner

SHAPED CHARGE GENERATION LAYER FOR A PHOTOCONDUCTIVE DRUM

This application claims priority to U.S. Provisional Application No. 62/927,203 filed Oct. 29, 2019, entitled Tapered Charge Generation Layer for Laser Printing Application, whose entire contents are incorporated herein as if set forth herein.

FIELD OF THE DISCLOSURE

The present disclosure relates to electrophotographic imaging devices having photoconductive drums imaged by optical scanning units. It relates further to drums having shaped charged generation layers and methods for making same to compensate for imperfections in the optical scanning units.

BACKGROUND

In an electrophotographic imaging device, for example, an optical scanning unit typically includes a scanning mirror which reflects a modulated light beam toward a plurality of optical components. Such optical components may include lenses and mirrors which direct and focus the reflected light beam to form light spots upon a surface of a photosensitive member, such as a photoconductive drum. As the scanning mirror moves, either in a reciprocating manner as with a torsion oscillator or rotationally as with a polygon mirror, the light beam reflected thereby is scanned across each of the optical components of the system. Ultimately, the light beam impinges and is swept across the photosensitive member as scan lines to form latent images thereon.

Optical performance of a scanning unit is generally very sensitive to positioning of the optical components and to consistent distribution of the light beam across the photosensitive member. As such, typical imaging devices include mechanical features like screws, cams, tilts, or other devices to enable angular/positional adjustments of the optical components to maintain alignment accuracy of the beam. They also include controller cards with chips, ASICs, drivers, etc., to electronically adjust power of the beam to compensate for optical aberrations or fringe effects that occur near edges of the scan lines, compared to centers of scan lines where scanning units more consistently distribute power. Color imaging units only exacerbate these problems because multiple photosensitive members all require optical registration with one another, yet each has differences in where its optical components are positioned. Unfortunately, electronic control of beams by way of controller cards adds much expense to printers, especially more economically priced printers. The inventors, thusly, identify a need to inexpensively correct deficiencies in scanning units.

The inventors also identify a need to utilize organic photoconductive drums for photosensitive members in imaging devices over inorganic drums as the former have better optical and electrical performance. Among these, organic photoconductive drums have a wider range of light absorbing wavelengths, higher photosensitivity and more stable chargeability. They also have relatively good manufacturability, low cost and low toxicity. The manufacturing process led the inventors to solving the foregoing scanning unit and other problems by creating a laminate organic photoconductive drum comprised of a substrate, such as a metal ground plane element, on which a shaped charge generation layer and a charge transport layer are coated. Skilled artisans will note further advantages as described below.

SUMMARY

A photoconductive drum includes an elongated support element with a shaped charge generation layer. The layer extends from the support element at various thicknesses along a length thereof. Thicker charge generation portions provide denser optical densities compared to thinner portions allowing tailoring the photoconductive drum to compensate for imperfect optical scanning systems. A charge transport layer overcoats the charge generation layer. Optionally, an oxidation layer underlies the charge generation layer as does a protective overcoat overlying the charge transport layer. Various thicknesses and shapes of the charge generation layer are also disclosed.

Shaping the charge generation layers includes preparing a dispersion having a charge generation composition and dipping the elongated support element into the dispersion. Withdrawing from the dispersion portions of the support element at differing speeds results in differing thicknesses of charge generation composition on the support element. Faster withdrawal results in thicker charge generation composition than does slower withdrawal.

DETAILED DESCRIPTION

Figure 1:
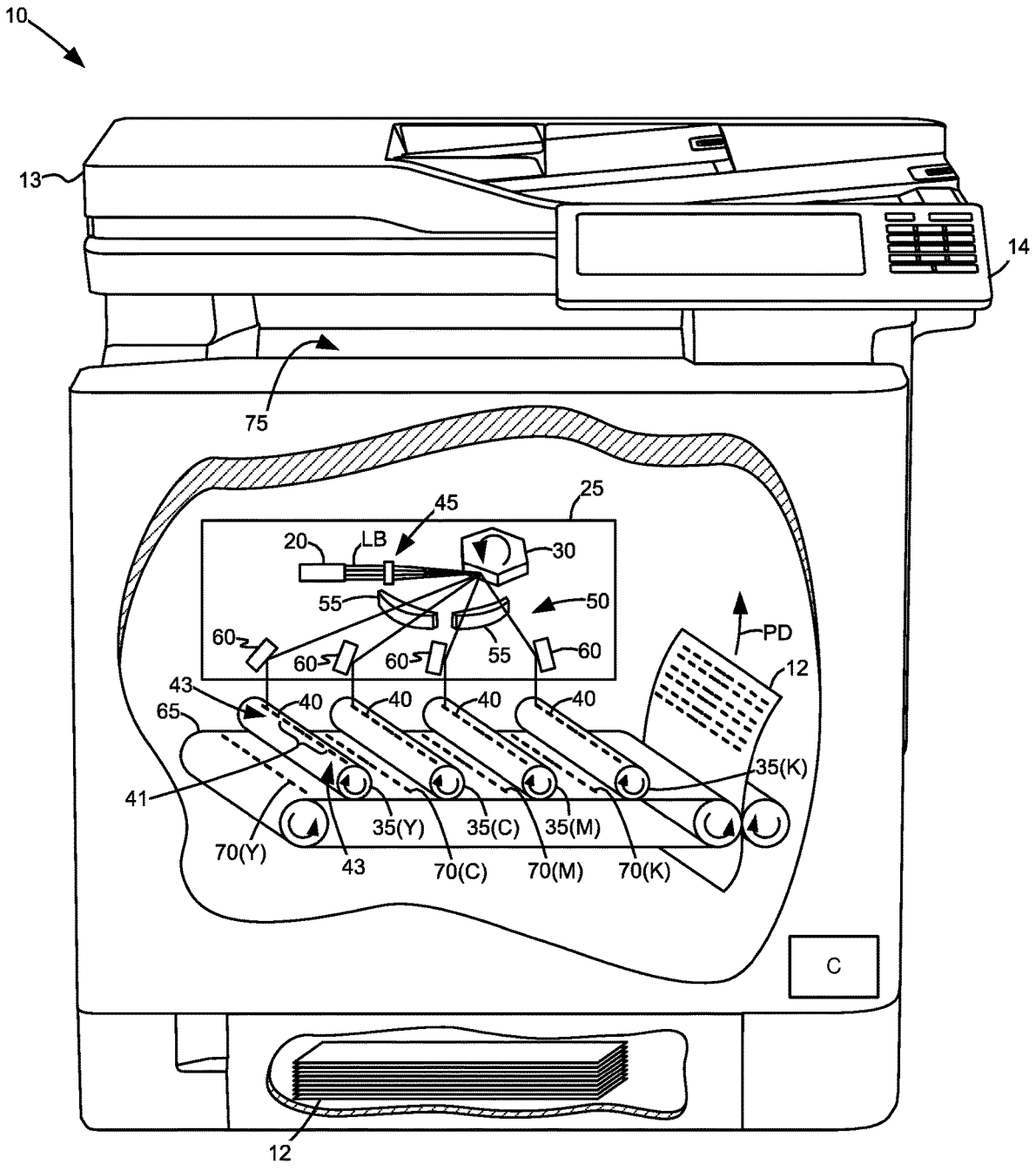
FIG. 1 is a diagrammatic view of an electrophotographic imaging device, including cutaway showing an abbreviated color imaging forming process with laser scanning unit and plural photoconductive drums.

With reference to FIG. 1, a color electrophotographic imaging device 10 is shown according to an example embodiment. Imaging device 10 is used for printing images on media 12. Image data of the image to be printed on the media is supplied to imaging device 10 from a variety of sources such as a scanner 13, computer, laptop, mobile device, or like computing device. The sources directly or indirectly communicate with imaging device 10 via wired and/or wireless connection. A controller (C), such as an ASIC(s), circuit(s), microprocessor(s), etc., receives the image data and controls hardware of imaging device 10 to convert the image data to printed data on the sheets of media 12.

Figure 16:
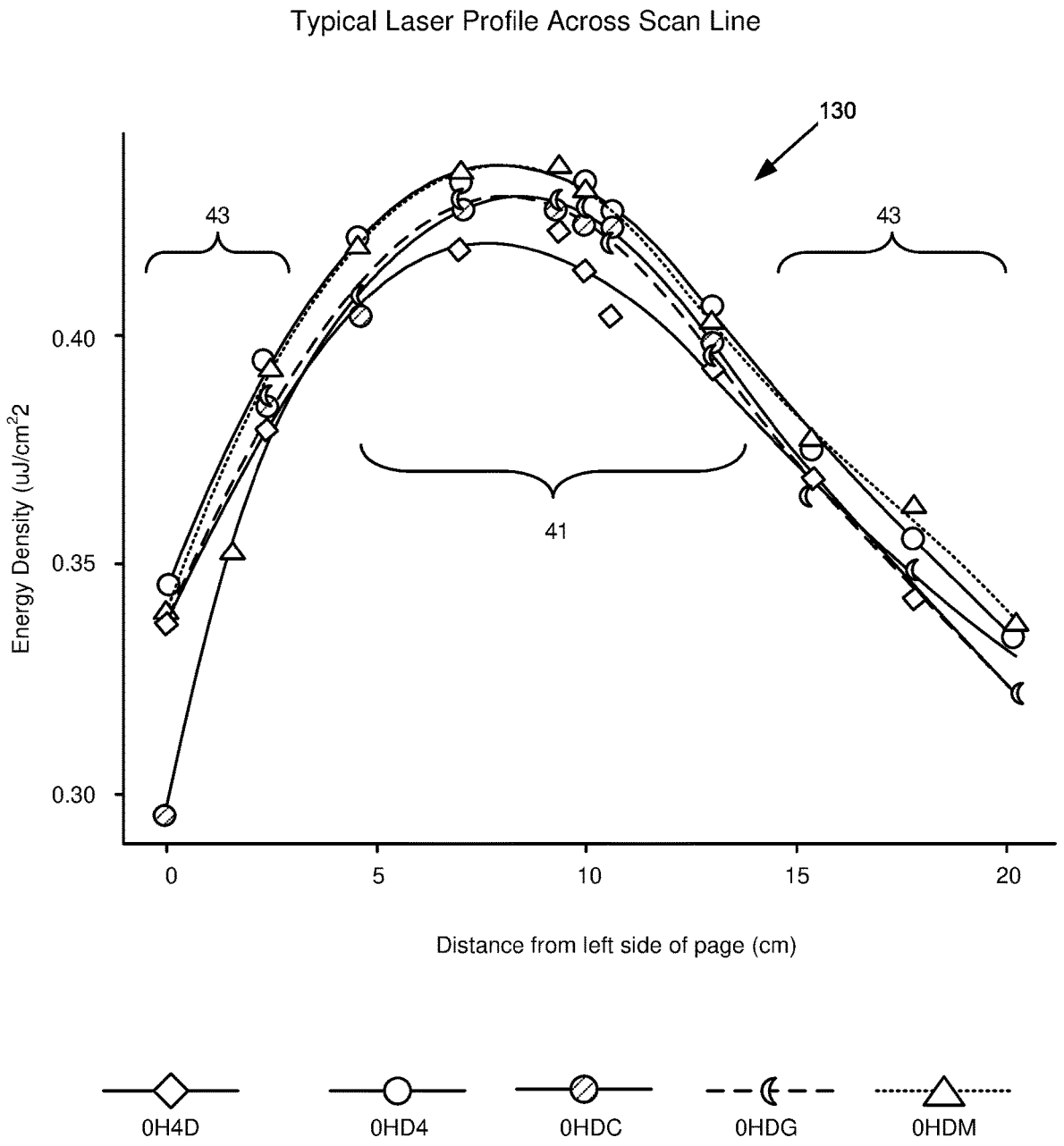
FIG. 16 (Prior Art)
FIG. 16 is a graph according to the prior art illustrating conventional power roll-off of a laser beam at edges along a media (page) corresponding to a scan line in a typical laser scanning unit.

During use, controller (C) controls one or more laser or light sources 20 in a laser scanning unit (LSU) 25 to produce modulated laser beams LB directed at a scanning mechanism, such as a polygon mirror 30. As the polygon mirror 30 rotates, laser beams LB are reflectively scanned to discharge areas of corresponding photoconductive (PC) drums 35 for each color plane (Y), (C), (M) and (K), and create latent images 40 in scan lines of the image data thereon. Pre-scan optics 45 and post-scan optics 50 in LSU 25 include lenses and mirrors that transform and direct laser beams LB from light source 20 to PC drums 35. For post-scan optics 50, lenses 55 serve to focus scanned laser beams LB into small spot sizes on corresponding PC drums 35 while mirrors 60 direct laser beams LB scanned by polygon mirror 30 toward respective PC drums 35. Downstream of the latent images 40 on PC drums 35, the printed image is formed by applying toner particles to the latent images 40 using developer units (not shown) and transferring a toned image 70 from each PC drum 35 to a transfer belt 65 which then transports the toned images 70 for transfer to a media sheet 12 travelling in a process direction PD. The media sheet 12 with the toned image enters a fuser (not shown) which applies heat and pressure to the media sheet 12 to fuse the toned image thereto. Ultimately, the media sheet 12 is either deposited into an output media area 75 or enters a duplex media path for imaging on the other side of the media sheet 12. Unfortunately, as noted in the background section, power distribution of the laser beams LB along a length of the scan lines of the latent image are not uniform. There exists more uniform power distribution near centers 41 of the scan lines on the PC drums and less uniform distribution near edges 43 of scan lines. FIG. 16 illustrates the problem (known sometimes as power roll-off) by mapping energy density of an actually tested, uncorrected LSU for a cyan color channel versus length in cm along a sheet of media. As seen, higher energy density values (above 0.4) reside in the center of the media and lower values (below 0.4) reside at the edges, corresponding to centers 41 and edges 43 of the PC drums.

Figure 2:
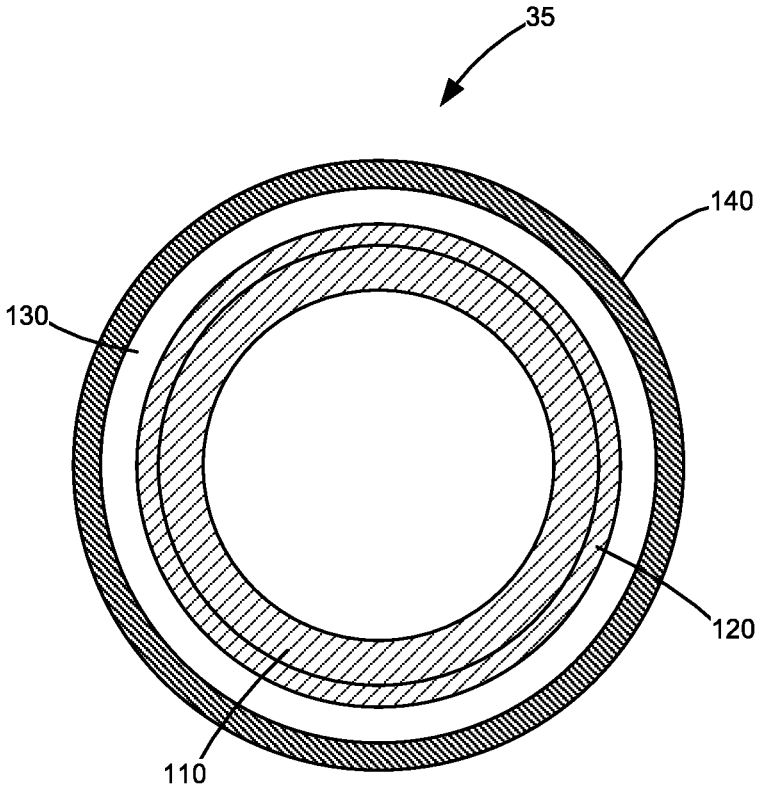
FIG. 2 is a cross-sectional view of a single photoconductive drum for use in the electrophotographic imaging device.
Figure 3A:
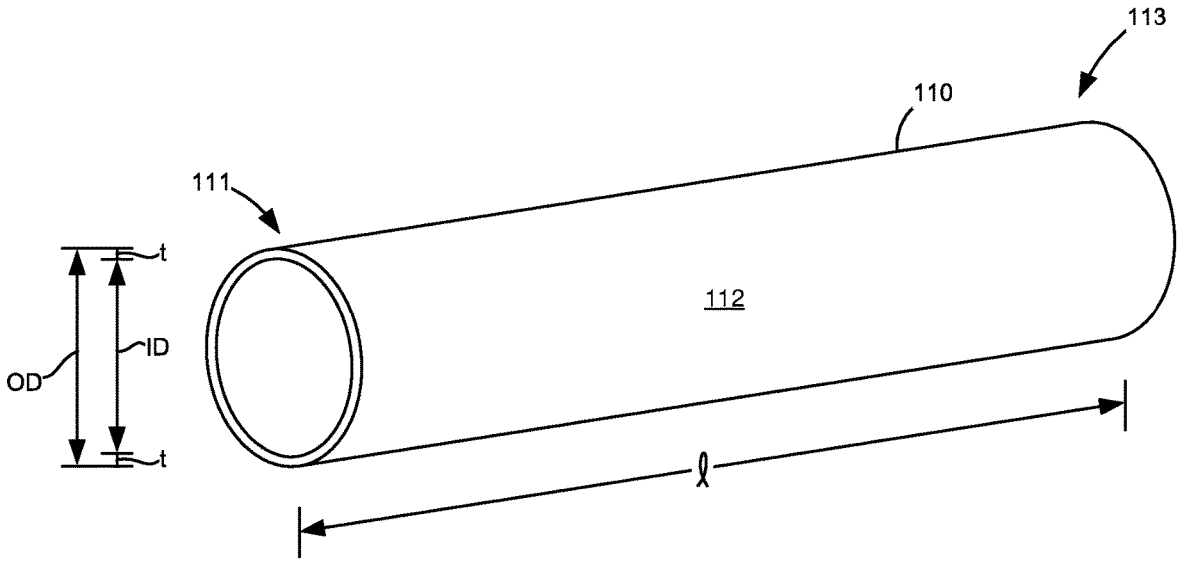
FIGS. 3(*a*)-3(*c*) are sequential diagrammatic views of fabricating a photoconductive drum.
Figure 3B:
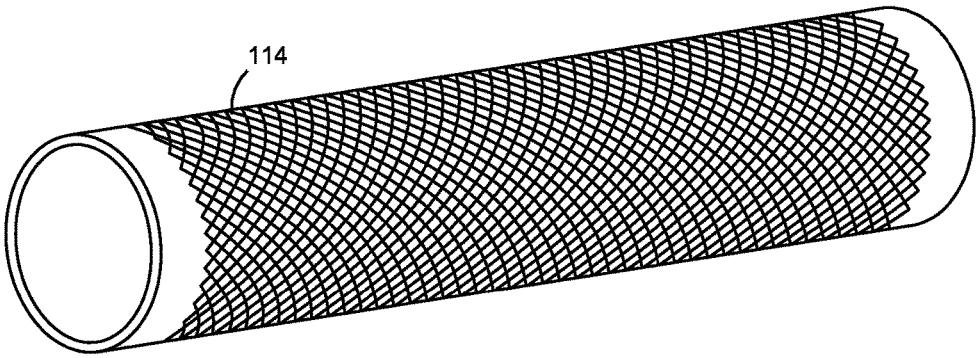
Figure 3C:
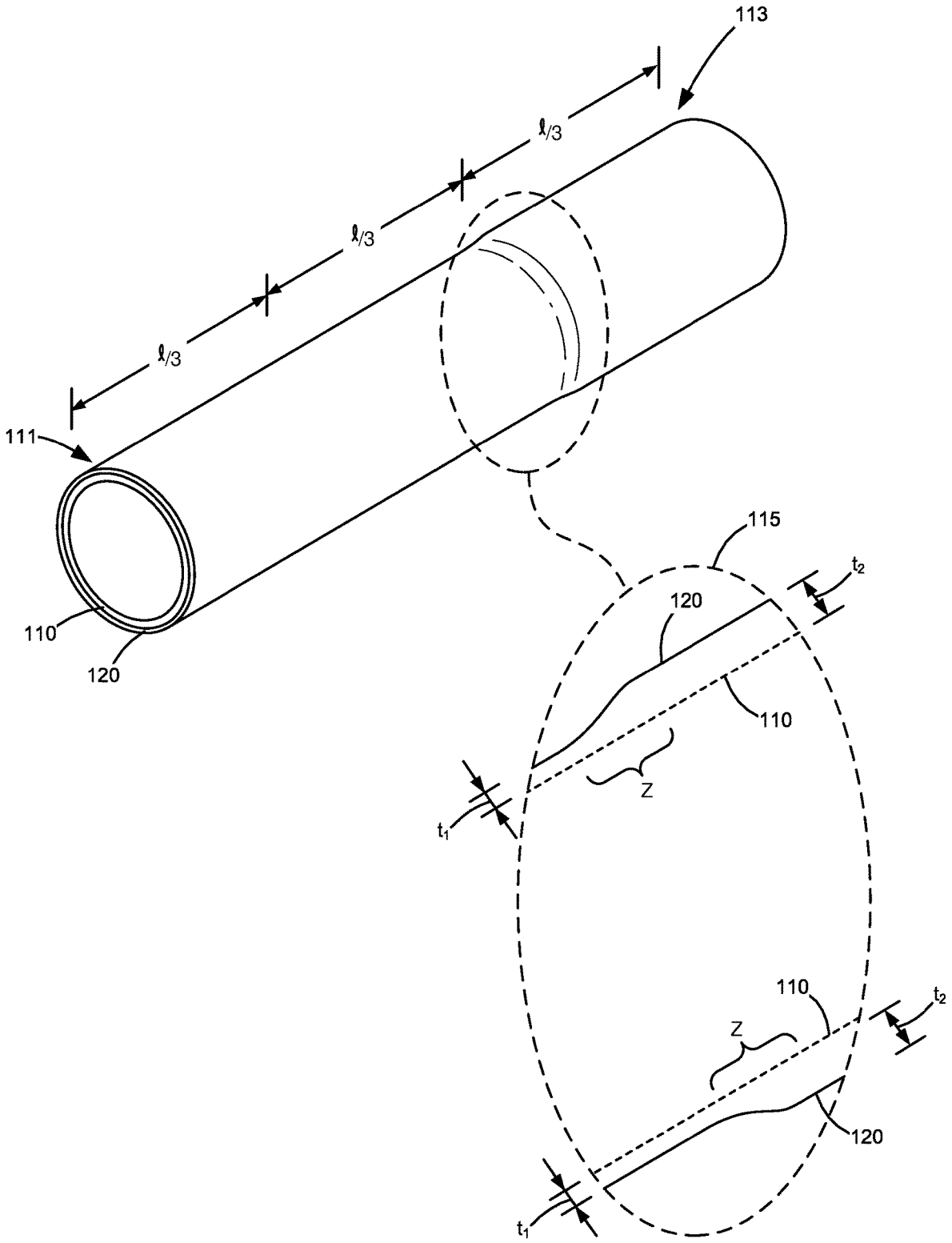

With reference to FIG. 2, a PC drum 35 according to an example embodiment of the present disclosure is given in more detail. In cross-section, the PC drum 35 typifies an organic drum having a hollow, base support element 110 upon which are coated a charge generation layer 120, a charge transport layer 130 and an optional protective overcoat layer 140. Additional layers may be included between the support element 110, the charge generation layer 220 and the charge transport layer 230, including oxidation layers, anodization layers, adhesive layers, and/or coating layers. In FIGS. 3*a*-3*c*, the drum is shown in sequence as it is processed.

In FIG. 3*a*, the support element 110 is generally cylindrical and hollow along its longitudinal axis (length (l)) extending from a proximate 111 to a distal end 113. In one embodiment, the length ranges from about 245 to about 255 mm. In another, the inner diameter (ID) ranges from about 20 to about 24 mm, while the outer diameter (OD) ranges from about 21 to about 25 mm thereby defining a thickness (t). Its composition is that of a conductive material, such as aluminum, iron, copper, gold, silver, etc. as well as alloys thereof. A preferred material is the aluminum alloy known as Aluminum 3003 alloy and such is formed by extrusion. In other embodiments, the support element defines a polymeric surface with a conductive coating and other shapes and support structures are also possible, such as with a belt. In any, an outer surface 112 of the support element optionally undergoes electrochemical anodization or oxidation that cuts into the surface at a depth of about 3 to about 5 μm. The resultant layer 114 is noted in FIG. 3B.

In FIG. 3C, the charge generation layer 120 is coated on the anodized/oxidized layer of the support element 110. The charge generation layer, as depicted in larger detail 115, but not to scale, has differing thicknesses relative to the underlying support element 110 shown in phantom. That is, a first thickness t1 extends away from the support element in a relatively thinner range of about 0.2 to about 0.5 μm, while a second thickness t2 extends away from the support element in a relatively thicker distance of about 0.1 μm thicker than the first distance. The transition in thickness occurs at a zone Z where thickness t2 tapers toward thickness t1 at about a one-third of the length (⅓) of the support from either the proximate 111 or distal end 113 (shown from the distal end in this embodiment). It is found by the inventors that using differing thicknesses results in the ability to alter the amount of discharge of the PC drum during use. In turn, the more discharge, the more toner will adhere to the drum. More toner, the darker the print. In this way, controlling where the differences in thickness occur of the charge generation layer, lighter print on media can be effectively darkened to compensate for power roll-off of the laser. All also can occur without needing extra optics in the LSU and/or firmware modifications in the controller, hence, resulting in significant improvement in both material cost and production efficiency.

Figure 4A:
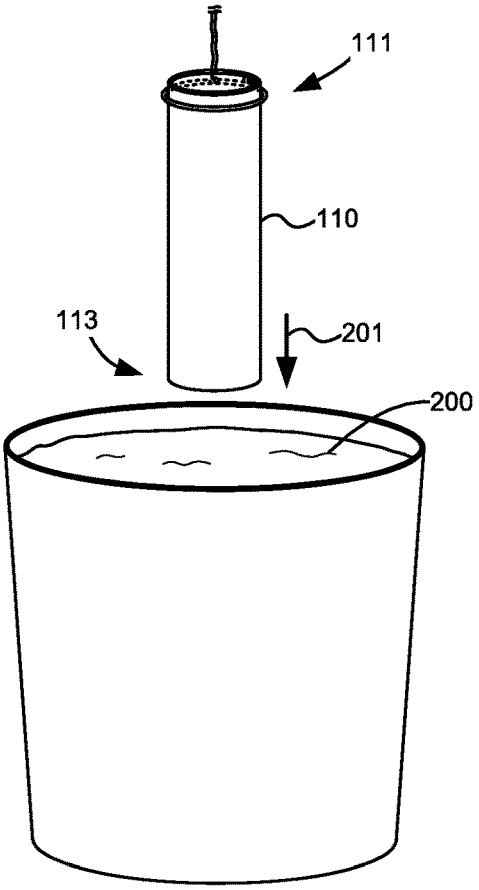
FIGS. 4(*a*)-4(*e*) are sequential manufacturing views greatly simplified for fabricating a shaped charge generation layer on a support element, including withdrawing from a dispersion at differing speeds during dip coating to form the shape.
Figure 4B:
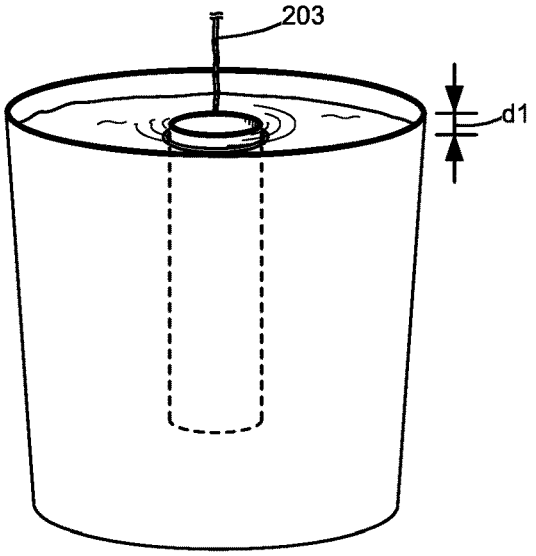

To actually create the difference in thicknesses of the charge generation layer, the inventors have further found a technique of dip-coating the charge generation layer with variable linear speed control. That is, FIGS. 4*a*-4*e* show an example of the technique. In FIG. 4*a*, a charge generation dispersion 200 is prepared. It includes generally a binder and a charge generation compound. In another, it includes a pigment dispersed evenly in one or more types of binders. In still another, the dispersion includes a type IV titanyl phthalocyanine, polyvinylbutyral, poly(methyl-phenyl)siloxane and poly p-hydroxystyrene in a mixture of 2-butanone and cyclohexanone solvents The polyvinylbutyral is available from Sekisui Chemical Co., Ltd under the trade name BX-1®. In any, the support element 110 is vertically dipped 201 into the dispersion along a longitudinal axis of the support element (generally parallel to the action arrow 201). The dipping into the dispersion occurs in distance as deep in the dispersion as desired in FIG. 4*b*, but mostly an entirety of the support element is dunked except for a terminal portion of the support element. The terminal portion resides above and out of the dispersion at a distance d1 where mechanical fixtures 203 attach to the support element to dunk it. The distance d1 is any, but about 2 mm defines one embodiment.

Figure 4C:
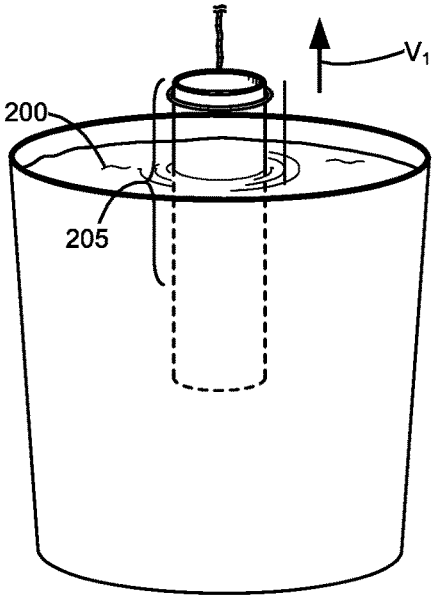
Figure 4D:
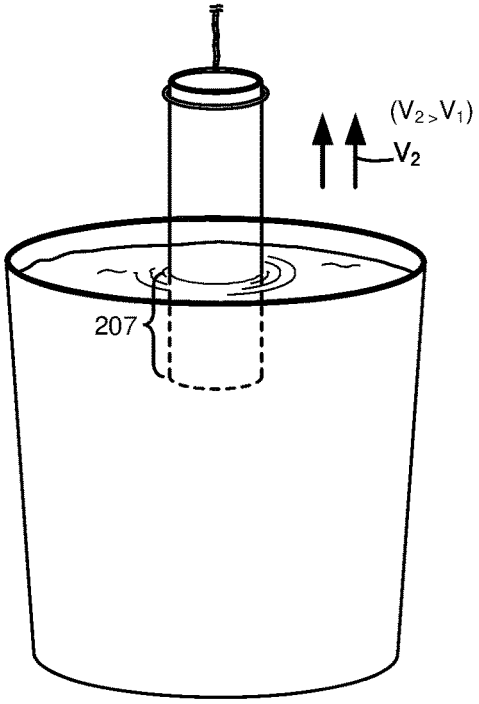
Figure 4E:
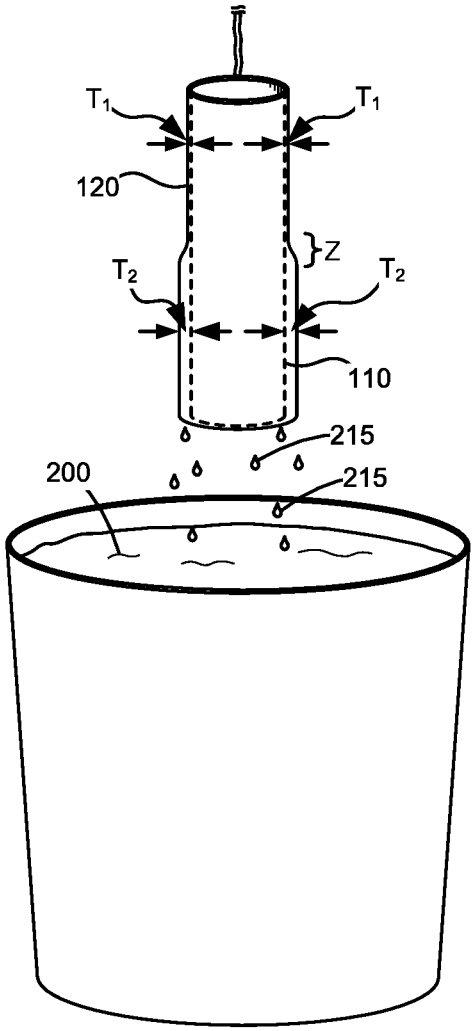

In FIG. 4*c*, a first portion 205 of the support element is withdrawn from the dispersion 200 at a first speed v1. This results in a uniform thickness of a charge generation layer annularly about the support element. In FIG. 4*d*, a second portion 207 of the support element is withdrawn from the dispersion at a second speed v2 faster than the first speed v1. This results in a second uniform thickness of the charge generation layer about the support element, but having a thickness thicker than the first portion of the charge generation layer as seen greatly exaggerated in FIG. 4*e*. A zone Z of transition also exists between the two thickness as the withdrawing ramps up speed from v1 to v2 until reaching steady state speed at v2. While not necessarily intuitive, the faster the rate (v2) of withdrawal of the support element 110 from the dispersion, the thicker (t2) the charge generation layer 120. Likewise, the slower the rate (v1) of withdrawal of the support element from the dispersion, the thinner the thickness (t1) of the charge generation layer. Owing to rheological and/or other properties of the withdrawing the support element from the dispersion, artisans can envision that the slower the rate of withdrawal, the more the charge generation layer is able to run-off 215 of the support element. Understanding this, the charge generation layer is ultimately controllable in shape and can be tailored.

Figure 5:
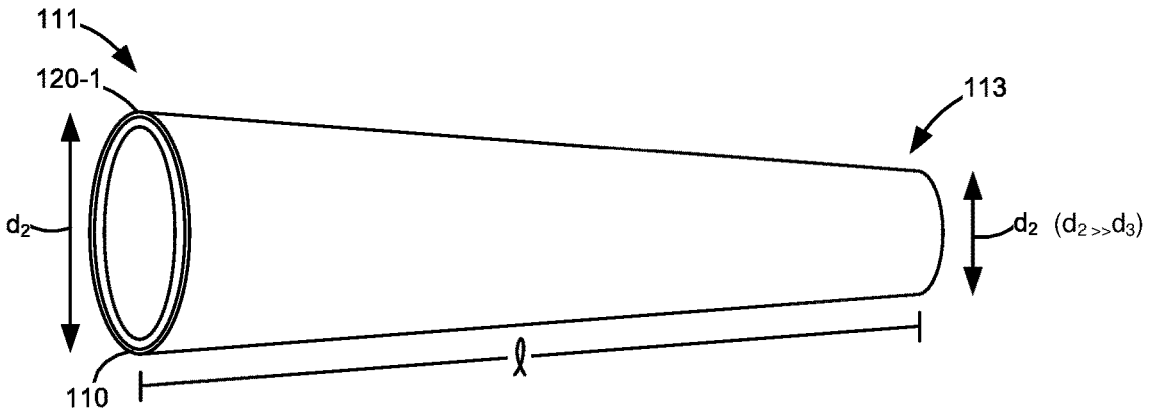
FIGS. 5-FIG. 8 are representative shapes of charge generation layers greatly exaggerated in scale for use on a photoconductive drum, noting a continually tapering layer in FIG. 5, a symmetrical layer tapering inward from ends toward a center in FIG. 6, a symmetrical layer having distal and proximate ends with thicker portions than a central region in FIG. 7, and a stepped layer in partial view in FIG. 8.
Figure 6:
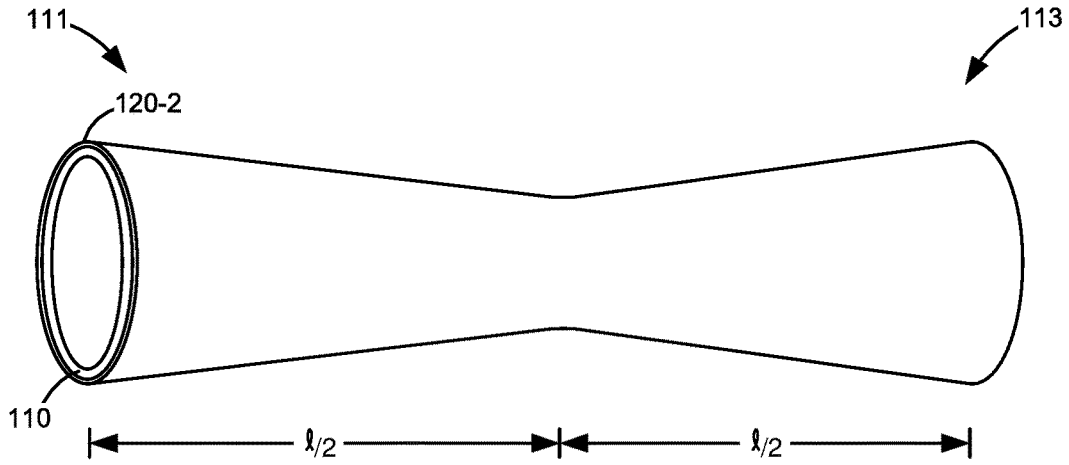
Figure 7:
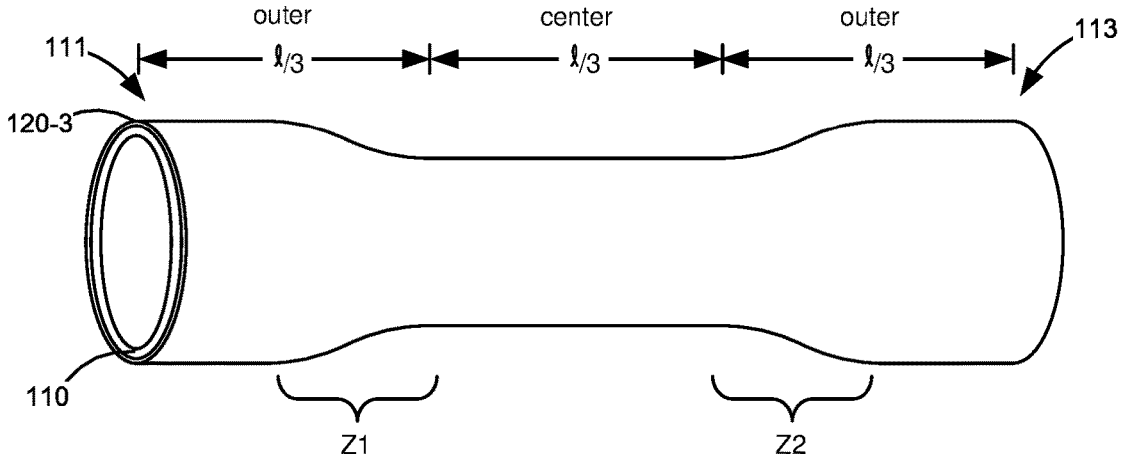
Figure 8:
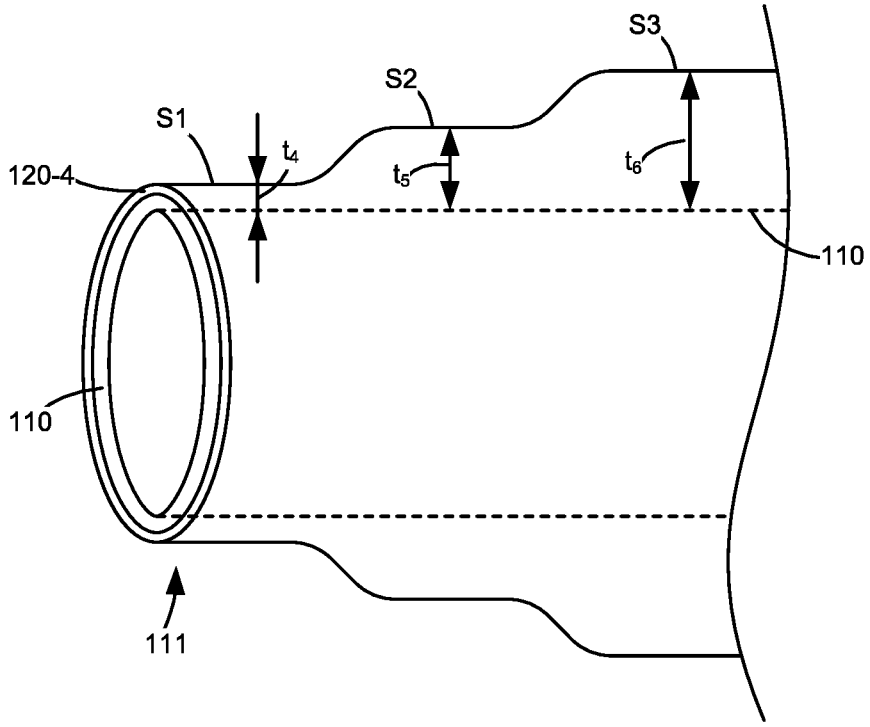

As seen in FIG. 5, for example, a charge generation layer 120-1 can exist on a support element 110 as a single angle of taper along a length l of the support element, whereby the proximate end 111 has a thickness such that distance d2 is greater than the distance d3 of the thickness of the charge generation layer on the distal end 113. This occurs by continually and uniformly slowing the rate of withdrawal of the support element from the dispersion. In FIG. 6, the charge generation layer 120-2 tapers uniformly from both the distal and proximate ends 113, 111 until reaching a center of the of the length (½) of the support element. The rate of withdrawing of the support element occurs similarly to FIG. 5, e.g., continually and uniformly slowing, but upon reaching the center of the support element the rate of withdrawal oppositely increases uniformly and continually in correspondence to the first half until the distal end 113 is fully withdrawn from the dispersion. In FIG. 7, the charge generation layer 120-3 is uniformly thick in the outer thirds of the length of the support element, whereas the center third is uniformly thinner. The rates of withdrawal here correspond to first removing the proximate end 111 at a first, constant rate of speed for a first third of the length of the support element, decreasing the rate of withdrawal to a second, constant speed slower than the first speed for the center third of the length, and finally increasing the rate of withdrawal back to the first, constant speed for the final third of the length until fully withdrawn from the dispersion. Naturally, zones Z1, Z2 of transition of thickness will exist as the first speed transitions to the second speed and then back to the first speed. In FIG. 8, a stepped profile in a speed of withdrawal exists for a charge generation layer of the type 120-4. Steps S1, S2, S3, etc. can be shaped by withdrawing the proximate end 111 of the support element at a first speed for step S1, increasing the speed of withdrawal to a second speed faster than the first speed for step S2, and increasing again to a third speed faster than the second speed for step S3, and so on. The result is stepped increases in thickness of the charge generation layer from thickness t4, to t5, to t6, etc. Of course, the foregoing are only representative and skilled artisans can readily envision other shapes.

Figure 9:
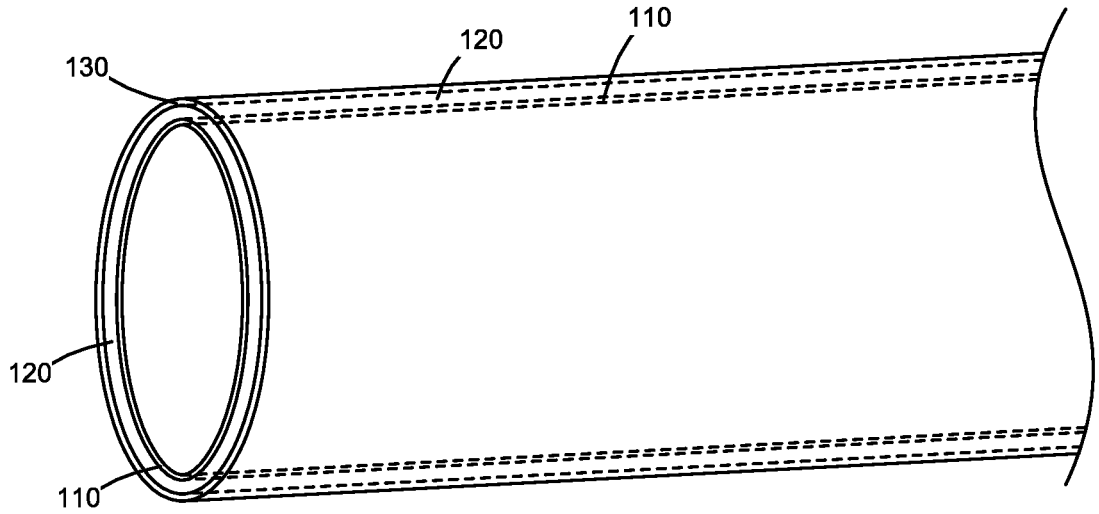
FIG. 9 is a diagrammatic view of a charge transport layer overlying a charge generation layer on a support element.

With reference to FIG. 9, a charge transport layer 130 is next applied to the support element after the charge generation layer 120. The charge transport layer is also dip coated, but uniformly so and not shaped liked the charge generation layer. Its thickness ranges much thicker than the charge generation layer in a range from about 17 to about 19 μm as measured by an eddy current tester. The layer is prepared from a formulation including triarylamine derivatives and polycarbonate at a weight ratio of 25-50% in a mixed solvent of THF and 1,4-dioxane. The charge transport layer is then cured. Similarly, the charge generation layer was cured before application of the charge transport layer.

Figure 10:
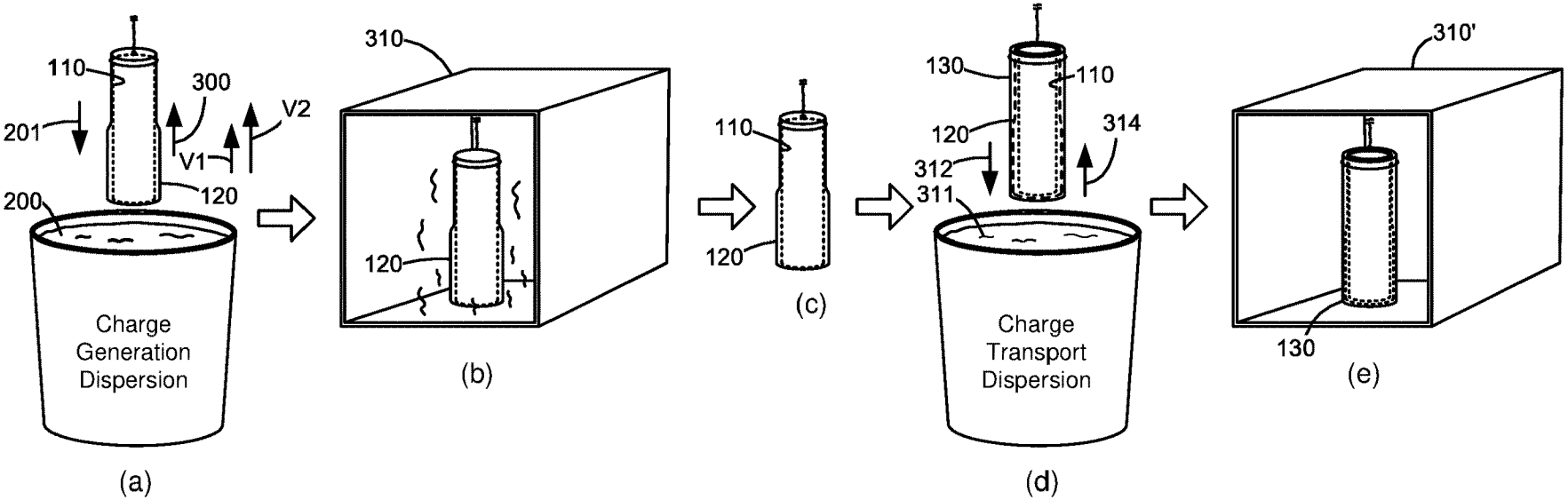
FIG. 10 is a diagrammatic view of sequences forming a photoconductive drum, including forming and curing a shaped charge generation layer and charge transport layer.

Thus, FIG. 10 notes more fully the process of manufacturing a photoconductive drum with a shaped charge generation layer including instances of curing the layers coated on the support element. At process (a), the support element 110 is dip coated with a charge generation material in a dispersion 200, as noted in earlier Figures. It is vertically dipped 201 into the dispersion 200 and withdrawn 300 at variable linear speeds, e., g., speeds v1 and v2 to obtain differing thickness of the layer 120. At process (b), the support element with charge generation layer is transported to an oven 310 where a baking instance occurs to remove solvents obtained from the dispersion. The baking occurs at a baking temperature in a range of about 99° to 102° C. for about twenty minutes, plus or minus 2-3 minutes. At process (c), the support element 110 with charge transport layer 120 is removed from the oven 310 and allowed to cool at room temperature, e.g., 20°-25° C., until it cools to less than 26° C. or until 1 hour of cooling occurs at room temperature, whichever occurs first. At process (d), the support element 110 with charge generation layer 120 is dip coated in a dispersion 311 of the charge transport formulation. It is vertically inserted 312 and removed 314 at a common speed. At process(e), the charge transport layer 130 is cured by baking in a same or different oven 310' at a peak baking temperature of about 120° C. for about one hour plus or minus 30 minutes to form the charge transport layer having a thickness of about 14-16 um.

Optionally, an overcoat layer 140 (FIG. 2) is coated over the charge transport layer. When used, it typifies a composition to protect the photoconductive drum from wear and abrasion over its lifetime without altering the electrophotographic properties of the drum. In one embodiment, the overcoat layer is a curable composition having nano metal oxide particles (e.g., indium tin oxide particles sized 30 nm to 300 nm) at about 15 percent by weight and a urethane resin about 85 percent by weight. The overcoat layer can be sprayed on or dipped coated over the charge transport layer. Curing can occur by exposure to either an electron beam or ultraviolet light then subject to a thermal cure at a temperature between about 75° C. and about 180° C. for a period ranging between about 30 minutes to about 90 minutes. The cured overcoat has a thickness in a range from about 1 to about 5 μm.

EXAMPLE

Figure 11:
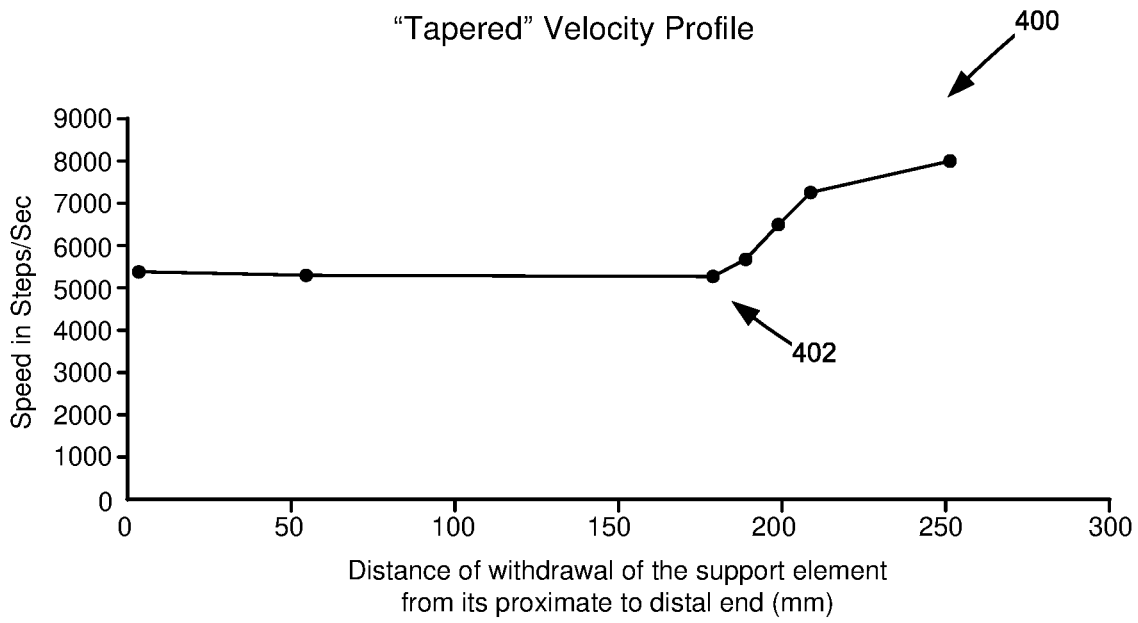
FIGS. 11 and 12 are velocity profiles corresponding to speeds of withdrawal of a support element from a charge generation dispersion to form a charge generation layer of the type according to FIGS. 3*c* and 7, respectively, and having the informal definition of "Tapered" and "Dual-Tapered," respectively, for use in understanding the graphs of FIGS. 13, 14 and 15.
Figure 12:
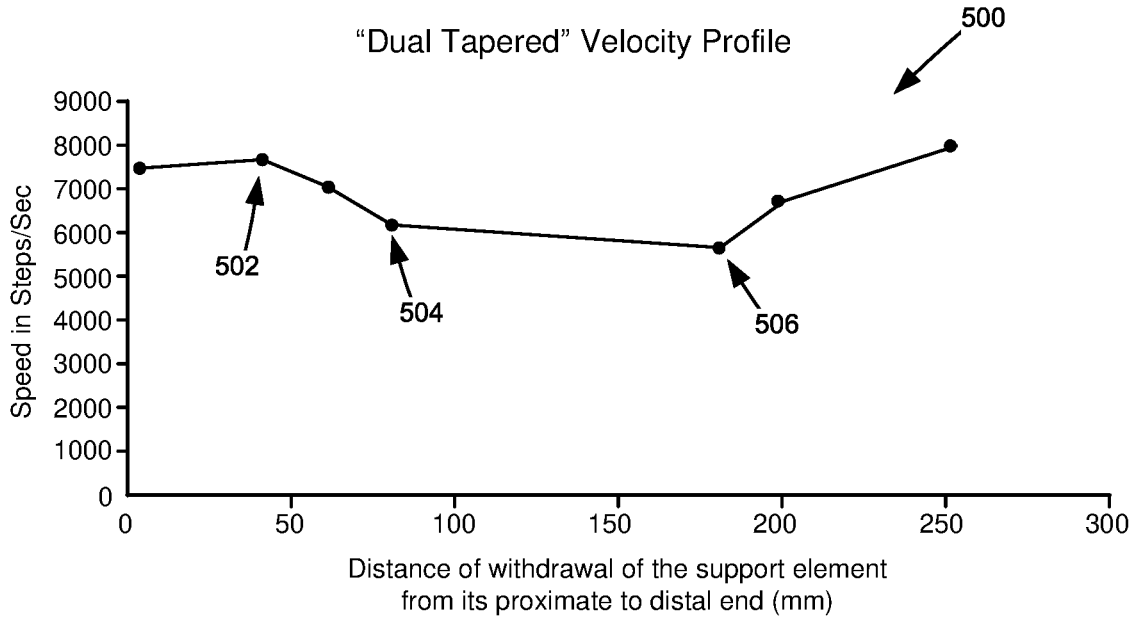

A charge generation (CG) dispersion was prepared from titanyl phthalocyanine type I and type IV, PVB S-Lec BX-1, poly(p-hydroxystyrene) and polyphenyl-methylsiloxane in methyl ethyl ketone and cyclopentanone. The particle size ranged from 300 nm to 400 nm. The charge generation layer was dip-coated according to FIGS. 4*a*-4*e* and dried (processes (b) and (c), FIG. 10). Development of the charge generation layer on the support element included withdrawing the support element from the dispersion for two designs hereafter labeled in FIGS. 13-15 as a "Tapered" and a "Dual Tapered" charge generation layer. Both designs are then compared to a "Standard" charge generation layer of the prior art having a generally cylindrical shape similar to the shape of its underlying support element. Further, the design labeled "Tapered" typifies a type of charge generation layer generally seen in FIG. 3*c*, while the design labeled "Dual Tapered" typifies a type of charge generation layer generally seen in FIG. 7. The withdrawal velocities (speed) of the support element from the dispersion are noted in the graphs 400 and 500 in FIGS. 11 and 12. In these examples, FIG. 11 shows a first speed of withdrawal of the support element happening until about 180 mm of distance along the length of the support element at position 402 and thereafter increasing the speed of withdrawal of the support element. In FIG. 12, a first speed of withdrawal of the support element from a charge generation dispersion occurs until about 40 mm, whereby the speed of withdrawal is reduced at position 502 until reaching a more constant speed at position 504 to position 506. Thereafter, the speed of withdrawal is increased for the remainder of the support element.

Figure 13:
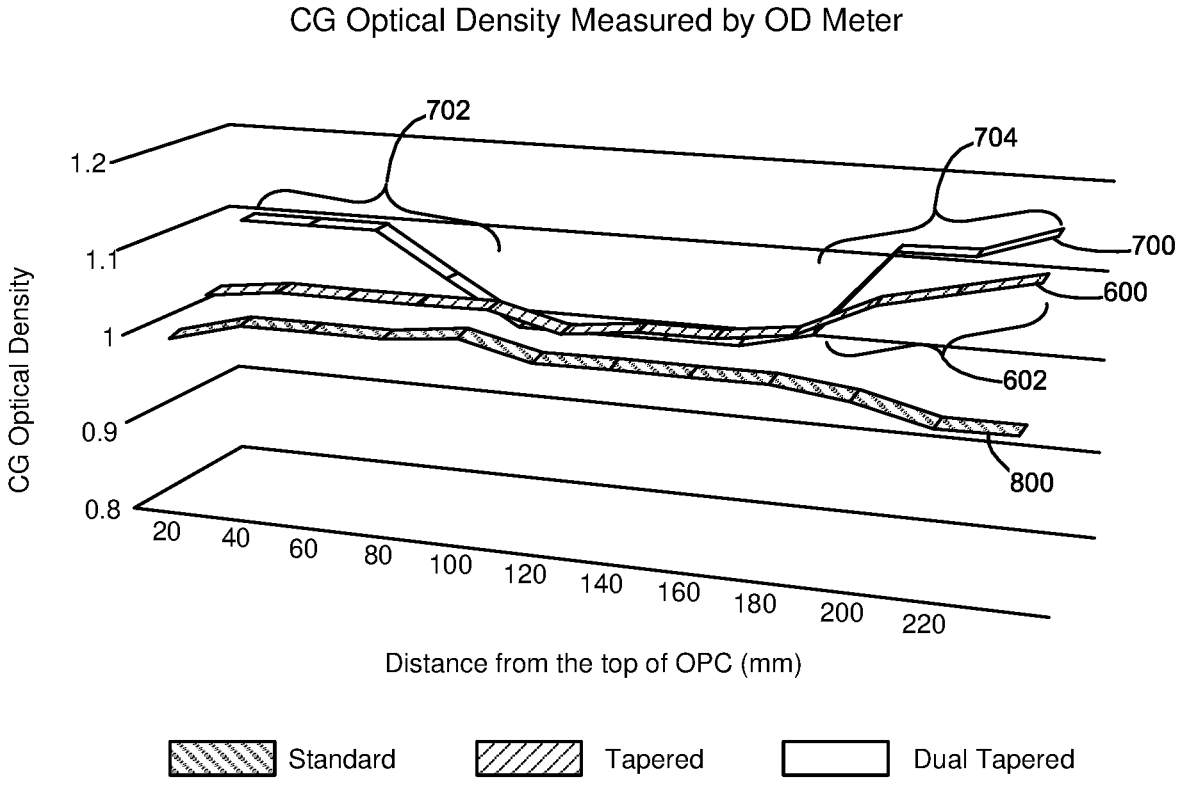
FIG. 13 is a graph illustrating various optical densities of a photoconductive (PC) drum with a shaped charge generation (CG) layer according to various shapes in comparison to a standard, prior art shape.
Figure 14:
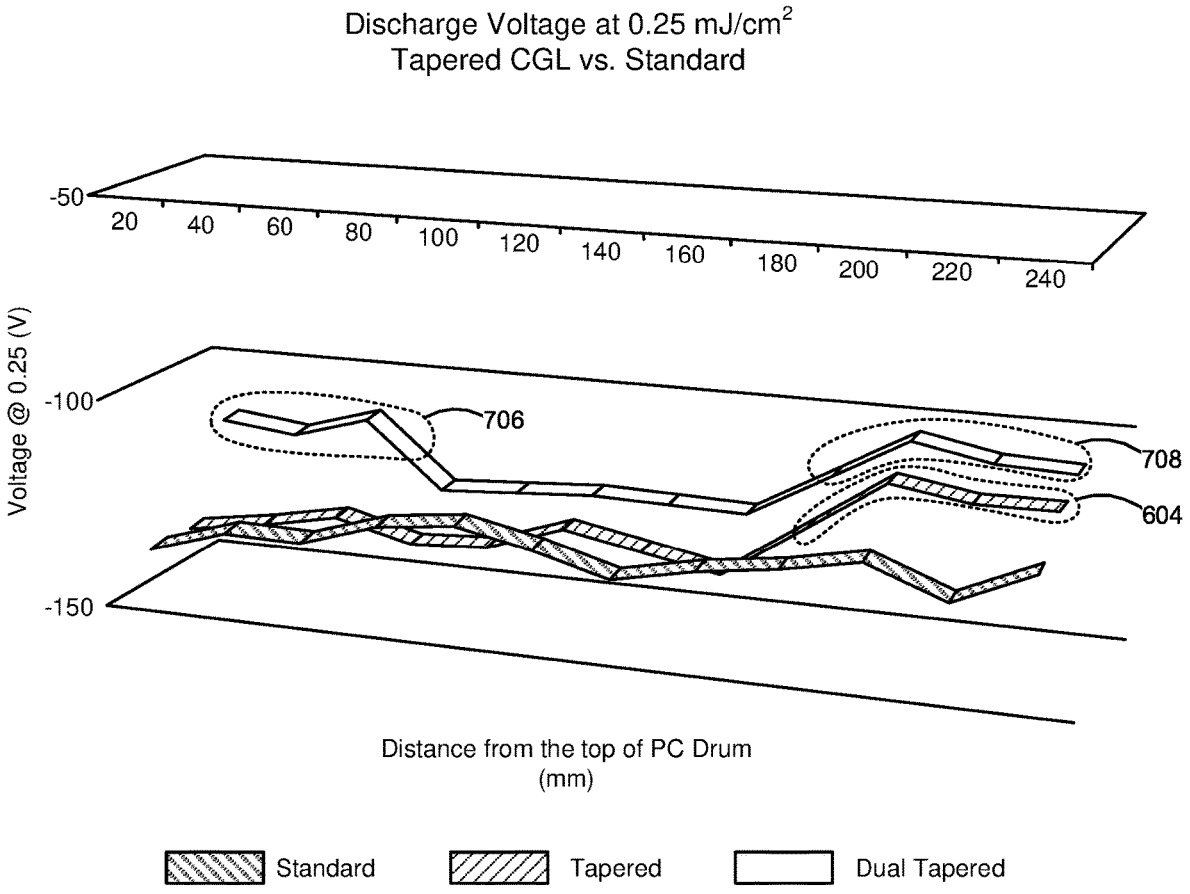
FIG. 14 is a graph illustrating discharge voltage of a photoconductive (PC) drum with a shaped charge generation layer (CGL) in comparison to a photoconductive drum having a standard, prior art cylindrically shaped charge generation layer.
Figure 15:
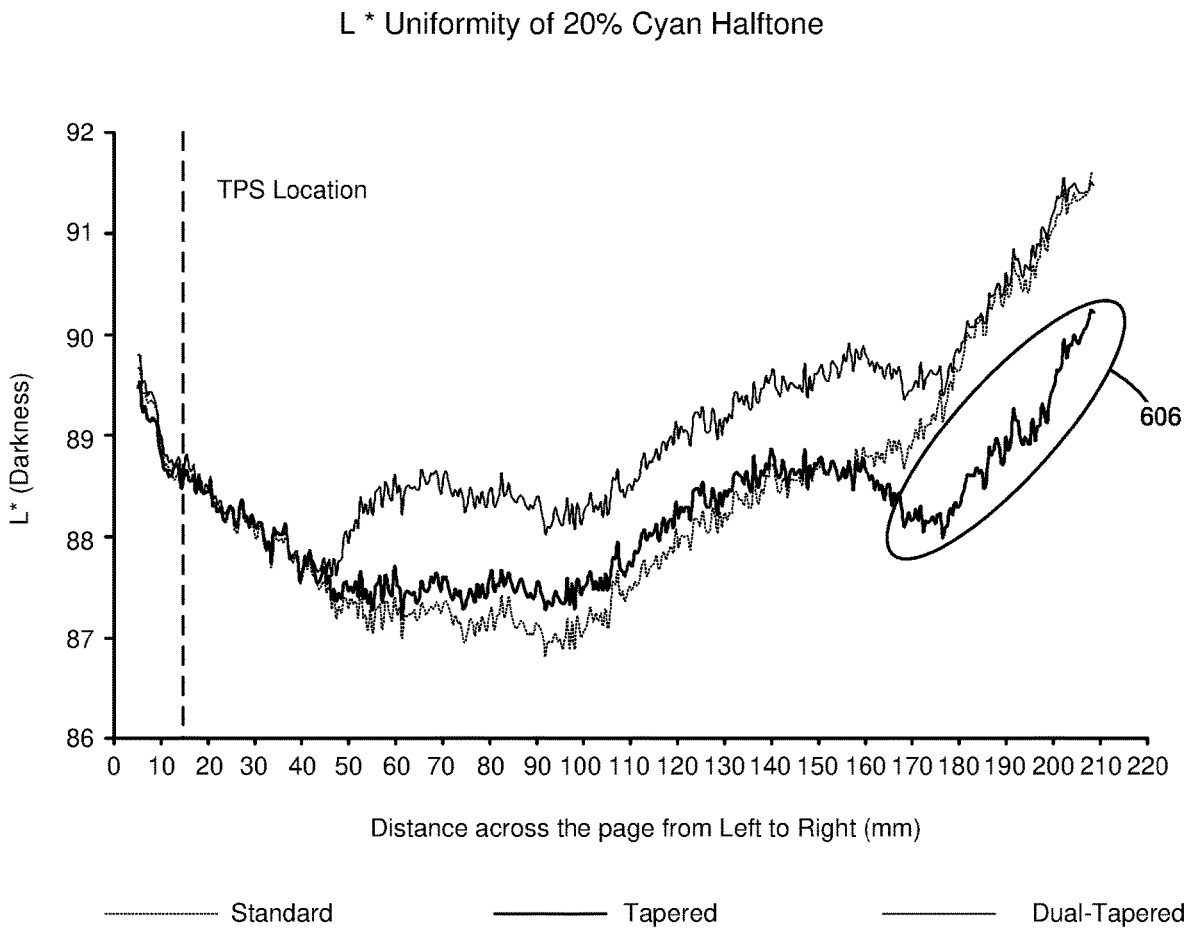
FIG. 15 is a graph illustrating darkness (L*) across a media (page) according to variously shaped charge generation layers of a photoconductive (PC) drum (the smaller the delta the lesser the variation in print darkness) (the smaller the L* the darker the print density).

In FIG. 13, then, the optical density is higher for both the Tapered 600 and Dual-Tapered 700 designs in comparison to the Standard 800 design. Namely, this is seen whenever the Tapered and Dual Tapered designs were withdrawn from the dispersion at increased speeds, such as at positions 602, 702 and 704, corresponding to the velocity profiles at positions 402, 502 and 506 of FIGS. 11 and 12. Similarly, FIG. 14 teaches higher discharge voltages at position 604 for the Tapered design and at positions 706 and 708 for the Dual Tapered design corresponding to the higher speeds of withdrawal in FIGS. 11 and 12 in comparison to the Standard design. As before, the higher the discharge voltage, the more toner can be attracted to the photoconductive drum at those positions, thereby improving darkness of a printed media at those same positions. In turn, the uniformity of darkness is improved along an entire length of the photoconductive drum as the edges of scan lines can be improved in optical performance thereby better matching the optical performance of the scan line near its center region. Again, this is all done without needing additional components or firmware adjustments to a controller card which add expense. FIG. 15 further confirms this, for example, with the Tapered design at position 606 where lower L* values correspond to darker print on a media (page), and such corresponds to position 402 where the velocity of withdrawal was increased for the support element at position 402 in FIG. 11, around 180 mm.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductive drum, comprising:

an elongated support element having a surface;

an oxidation layer on the surface;

a charge generation layer disposed over the oxidation layer, the charge generation layer having a uniform first thickness along about two-thirds of a length of the elongated support element ranging from about 0.2 to about 0.5 μm and, along about one-third of a remainder of the length of a distal or proximate end of the elongated support element, the charge generation layer having a uniform second thickness greater than the first thickness and being distinct from the first thickness by a transition in thickness from a middle one-third of the length of the elongated support element; and a charge transport layer disposed over the charge generation layer.

2. The photoconductive drum of claim 1, further including a protective overcoat over the charge transport layer.

3. The photoconductive drum of claim 1, wherein the second thickness is about 0.1 μm thicker than the first thickness.

4. The photoconductive drum of claim 1, wherein the elongated support element is substantially cylindrical about a longitudinal axis thereof.

5. The photoconductive drum of claim 1, wherein the charge generation layer tapers symmetrically from the second thickness to the first thickness at the transition in thickness.

6. The photoconductive drum of claim 1, wherein the elongated support element is a 3003 aluminum alloy.

7. The photoconductive drum of claim 1, wherein the elongated support element is hollow with an inner and outer diameter being in a range of about 20 to about 25 mm and having said length in a range of about 245 to about 255 mm.

8. The photoconductive drum of claim 1, wherein the oxidation layer is about 3 to about 5 μm.

9. The photoconductive drum of claim 1, wherein the charge transport layer is about 17 to about 19 μm.

10. The photoconductive drum of claim 1, wherein an active ingredient of the charge generation layer is titanyl phthalocyanine.

11. A photoconductive drum, comprising:

a substantially cylindrical elongated support element having a length and being an aluminum alloy;

a charge generation layer disposed over the elongated support element, the charge generation layer having a uniform first thickness along about two-thirds of the length of the elongated support element ranging from about 0.2 to about 0.5 μm and, along about one-third of a remainder of said length of the elongated support element, the charge generation layer having a uniform second thickness greater than the first thickness by about 0.1 μm and being distinct from the first thickness by a transition in thickness from a middle one-third of the length of the elongated support element; and a charge transport layer disposed over the charge generation layer.

12. The photoconductive drum of claim 11, further including an oxidation layer on a surface of the elongated support element.

13. The photoconductive drum of claim 11, wherein about 2 mm of the elongated support element is uncoated with the charge generation layer.

14. The photoconductive drum of claim 11, wherein the elongated support element is hollow with an inner and outer diameter being in a range of about 20 to about 25 mm and having said length in a range of about 245 to about 255 mm.

15. The photoconductive drum of claim 11, wherein the charge transport layer extends in thickness about the elongated support element in a range of about 17 to about 19 μm.

16. The photoconductive drum of claim 11, wherein the charge generation layer is polyvinylbutyral.

* * * * *